US012344982B2

(12) United States Patent
Yoon et al.

(10) Patent No.: US 12,344,982 B2
(45) Date of Patent: Jul. 1, 2025

(54) AUTOMATIC SELF-CLEAN CYCLE PRIOR TO DRYING CYCLE IN A LAUNDRY APPLIANCE

(71) Applicant: Haier US Appliance Solutions, Inc., Wilmington, DE (US)

(72) Inventors: Je Kwon Yoon, Seongnam (KR); Seonghoon Ryu, Seoul (KR); Wonmyung Seo, Gyeonggi-do (KR); Jaewon Jo, Seongnam-si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 293 days.

(21) Appl. No.: 17/742,604

(22) Filed: May 12, 2022

(65) Prior Publication Data

US 2023/0366139 A1 Nov. 16, 2023

(51) Int. Cl.
*D06F 33/68* (2020.01)
*D06F 33/69* (2020.01)
(Continued)

(52) U.S. Cl.
CPC ..... *D06F 33/68* (2020.02); *D06F 33/69* (2020.02); *D06F 2101/20* (2020.02);
(Continued)

(58) Field of Classification Search
CPC ..... D06F 33/68; D06F 33/69; D06F 2101/20; D06F 2103/70; D06F 2105/52; D06F 2105/54
See application file for complete search history.

(56) References Cited

U.S. PATENT DOCUMENTS

| | | | | |
|---|---|---|---|---|
| 11,085,137 | B2 | 8/2021 | Salvi et al. | |
| 2012/0144872 | A1 | 6/2012 | Kappler et al. | |
| 2016/0194806 | A1* | 7/2016 | Jang | D06F 33/43 8/137 |

FOREIGN PATENT DOCUMENTS

| | | | |
|---|---|---|---|
| CN | 104775270 | A | 7/2015 |
| CN | 111455611 | A | 7/2020 |

(Continued)

OTHER PUBLICATIONS

CN 112726109A to Shan. (Year: 2021).*

*Primary Examiner* — Joseph L. Perrin
(74) *Attorney, Agent, or Firm* — Dority & Manning, P.A.

(57) ABSTRACT

A laundry appliance includes a drum rotatably mounted within a cabinet and defining a chamber configured for receiving a load of clothes, a door pivotally mounted to the cabinet for providing selective access to the chamber, and a user interface for controlling operation of the laundry appliance. A controller is configured to monitor the number of wash cycles that have occurred in the laundry appliance since the last self-clean cycle. Once the laundry appliance reaches a predetermined number of wash cycles without an intervening self-clean cycle, an automatic self-clean cycle is initiated upon the next selection of a drying cycle by the user, wherein the drying cycle provides an indication that the chamber is empty of article of laundry and that the user has no further immediate washing needs. In these circumstances, the controller is configured to reconfigure the selected drying cycle into a combination cycle including a self-clean cycle which is automatically followed by the desired drying cycle.

18 Claims, 4 Drawing Sheets

(51) Int. Cl.

| | |
|---|---|
| ***D06F 101/20*** | (2020.01) |
| ***D06F 103/70*** | (2020.01) |
| ***D06F 105/52*** | (2020.01) |
| ***D06F 105/54*** | (2020.01) |

(52) U.S. Cl.
CPC ..... *D06F 2103/70* (2020.02); *D06F 2105/52* (2020.02); *D06F 2105/54* (2020.02)

(56) References Cited

FOREIGN PATENT DOCUMENTS

| | | | | | |
|---|---|---|---|---|---|
| CN | 112575524 | A | | 3/2021 | |
| CN | 112726109 | A | * | 4/2021 | ..... D06F 33/43 |
| KR | 20050041504 | A | | 5/2005 | |
| KR | 101082886 | B1 | | 11/2011 | |
| TW | 201326503 | A | | 7/2013 | |

* cited by examiner

AUTOMATIC SELF-CLEAN CYCLE PRIOR TO DRYING CYCLE IN A LAUNDRY APPLIANCE

FIELD OF THE INVENTION

The present subject matter relates generally to self-clean cycles in laundry appliances, or more specifically, to the selective and automated implementation of self-clean cycles in combination with a drying cycle in laundry appliances.

BACKGROUND OF THE INVENTION

Washing machine appliances generally include a tub for containing water or wash fluid, e.g., water and detergent, bleach, and/or other wash additives. A drum is rotatably mounted within the tub and defines a wash chamber for receipt of articles for washing. During normal operation of such washing machine appliances, the wash fluid is directed into the tub and onto articles within the wash chamber of the drum. The drum or an agitation element can rotate at various speeds to agitate articles within the wash chamber, to wring wash fluid from articles within the wash chamber, etc. During a spin or drain cycle of a washing machine appliance, a drain pump assembly may operate to discharge water from within sump.

Notably, when the wash or rinse cycle is completed, excess wash fluid commonly collects in a bottom of the tub, within the door gasket, on internal surfaces, etc. Because the wash tub is partially or substantially sealed, this wash fluid remains in the tub until the next wash or rinse cycle and the humidity remains relatively constant between cycles. Such collected wash fluid, excessive humidity, and moisture may contribute to mold, mildew, or foul smells. If the problem persists, the odors can affect the smell of articles of laundry that have been through a wash cycle. Failure to address this build up on a regular basis may lead to the misconception that the washing machine appliance is no longer effectively cleaning the clothes.

In order to eliminate these issues, conventional appliances include preprogrammed self-clean cycles that are performed to clean the various surfaces and components of the appliance. However, consumers tend not to utilize the self-clean cycle for a number of possible reasons, including a lack of recognition of the build-up in their washing machine appliance. In other circumstances, users may prefer not to run a self-clean cycle because the cycles tend to be lengthy, extending up to eight hours, thus precluding use of the machine for its intended purpose.

Some have attempted to address this problem by automatically initiating a self-clean cycle after a predetermined time period or number of wash cycles. However, consumers dislike this feature because it may start a lengthy self-clean cycle at a time that is inconvenient for the consumer. Often, such automated cycles are prematurely terminated by the user, thereby limiting their effectiveness. Alternative attempts to address this problem involve providing the user with a visual indication that it is time to run a self-clean cycle, for example, after a predetermined number of wash cycles. However, such visual indications can, and often are, ignored by the user. If the user fails to heed the alert, the problem persists.

Accordingly, a laundry appliance including features and operating methods for initiating a self-clean cycle automatically at a time that is convenient for the user is desirable. More specifically, a method for initiating a self-clean cycle in advance of a requested drying cycle, which provides an indication that the user is done with washing activities, would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a laundry appliance is provided including a cabinet, a drum rotatably mounted within the cabinet and defining a chamber, a door pivotally mounted to the cabinet for providing selective access to the chamber, a user interface for controlling operation of the appliance, and a controller operably coupled to the user interface. The controller may be configured to identify the selected cycle based on an input from the user interface, determine whether a wash counter exceeds a predetermined threshold if the selected cycle is a drying cycle, configure an execution cycle based on the selected cycle and the determination whether the wash counter exceeds the predetermined threshold, and execute the execution cycle.

In another exemplary embodiment, a method of operating a laundry appliance is provided. The laundry appliance includes cabinet, a drum rotatably mounted within a cabinet and defining a chamber, a user interface for controlling operation of the laundry appliance, and a controller operably couple to the user interface. The method includes identifying the selected cycle based on an input from the user interface, determining whether a wash counter exceeds a predetermined threshold if the selected cycle is a drying cycle, configuring an execution cycle based on the selected cycle and the determination whether the wash counter exceeds the predetermined threshold, and executing the execution cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
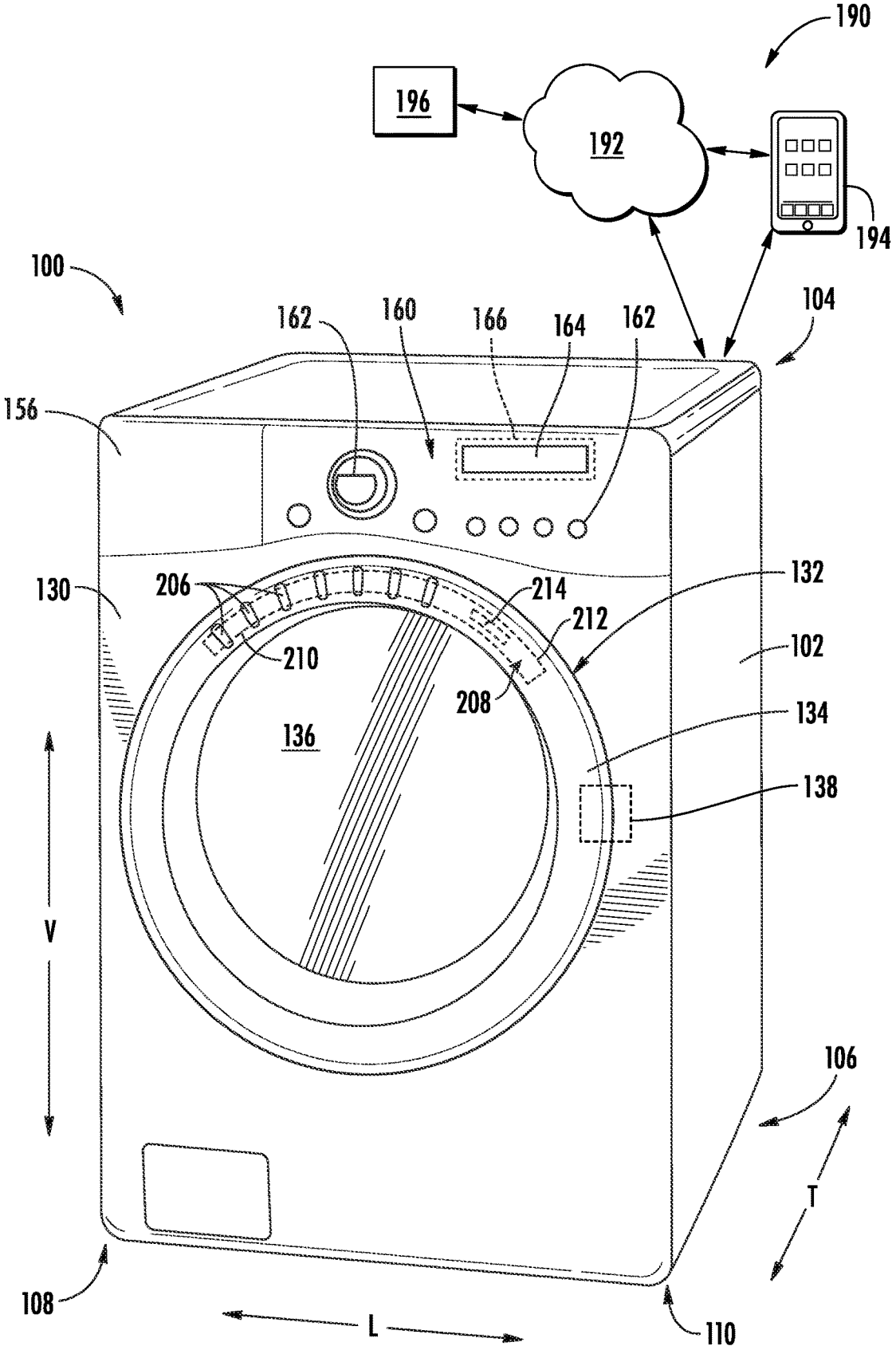
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
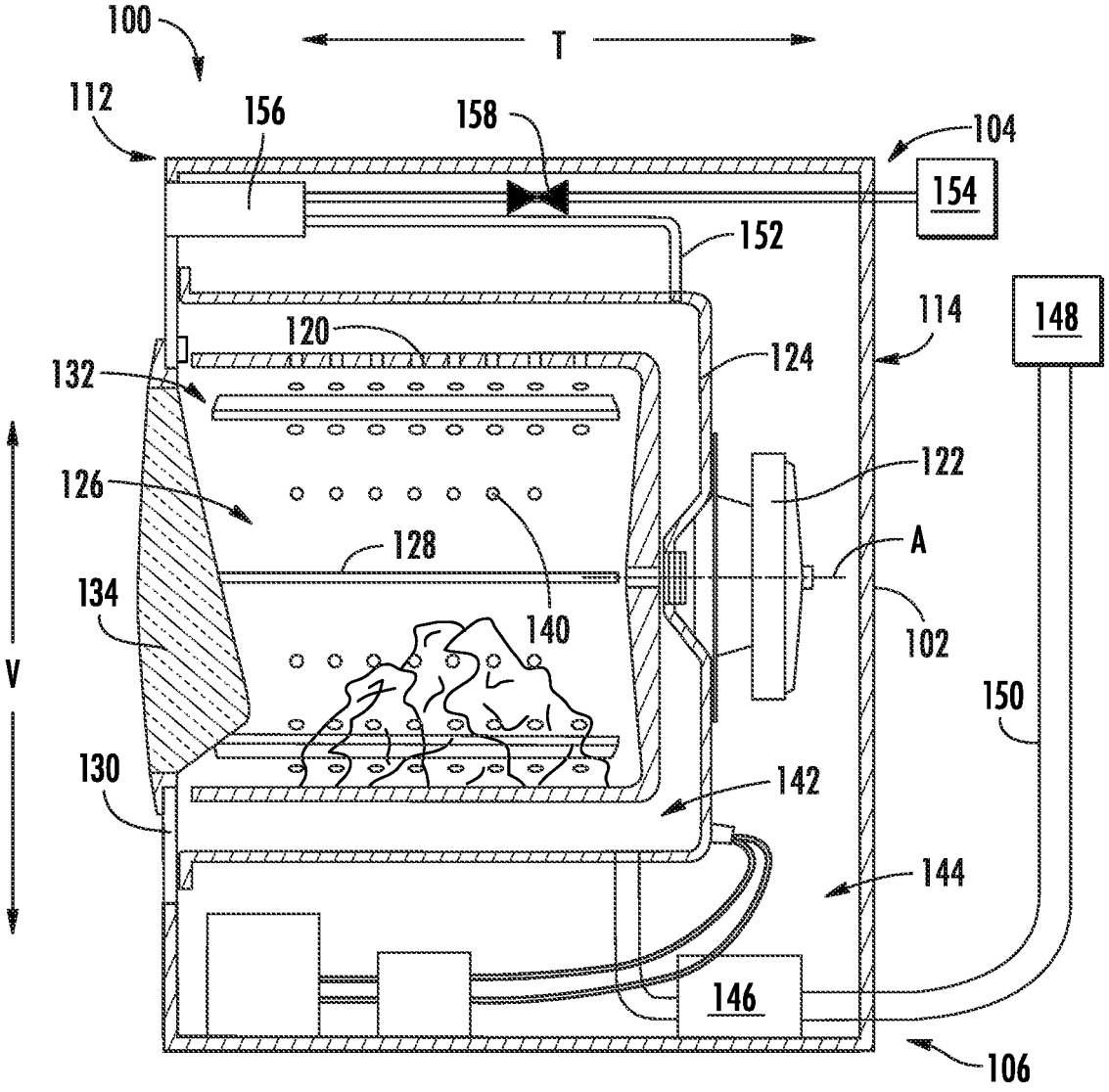
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T (FIG. 2).

Referring to FIG. 2, a drum 120 is rotatably mounted within cabinet 102 such that it is rotatable about an axis of rotation A. A motor 122, e.g., such as a pancake motor, is in mechanical communication with drum 120 to selectively rotate drum 120 (e.g., during an agitation or a rinse cycle of washing machine appliance 100). Drum 120 is received within a wash tub 124 and defines a wash chamber 126 that is configured for receipt of articles for washing. The wash tub 124 holds wash and rinse fluids for agitation in drum 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Drum 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in drum 120 during rotation of drum 120.

Referring generally to FIGS. 1 and 2, cabinet 102 also includes a front panel 130 which defines an opening 132 that permits user access to drum 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of drum 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, drum 120 also defines a plurality of perforations 140 in order to facilitate fluid communication between an interior of drum 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from drum 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

Referring again to FIG. 1, control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users. Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into drum 120 through opening 132, and washing operation is initiated through operator manipulation of input selectors 162. Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling drum 120 to the appropriate level for the amount of articles being washed and/or rinsed. By way of example for a wash mode, once drum 120 is properly filled with fluid, the contents of drum 120 can be agitated (e.g., with ribs 128) for washing of laundry items in drum 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within drum 120. One or more spin cycles may also be used. In particular, a spin cycle may be applied after the wash cycle and/or after the rinse cycle in order to wring wash fluid from the articles being washed. During a final spin cycle, drum 120 is rotated at relatively high speeds and drain assembly 144 may discharge wash fluid from sump 142. After articles disposed in drum 120 are cleaned, washed, and/or rinsed, the user can remove the articles from drum 120, e.g., by opening door 134 and reaching into drum 120 through opening 132.

Notably, controller 166 of washing machine appliance 100 (or any other suitable dedicated controller) may be communicatively coupled to control panel 160 and input selectors 162, and other components of washing machine appliance 100, such as fan 204 and humidity sensor 202. As explained in more detail below, controller 166 may be programmed or configured for automating elements of the washing machine appliance 100 at particular times as part of particular cycles, e.g., such as initiating an automated drying cycle upon completion of a self-cleaning cycle with little or no user intervention.

Referring still to FIG. 1, a schematic diagram of an external communication system 190 will be described according to an exemplary embodiment of the present subject matter. In general, external communication system 190 is configured for permitting interaction, data transfer, and other communications with washing machine appliance 100. For example, this communication may be used to provide and receive operating parameters, cycle settings, performance characteristics, user preferences, user notifications, or any other suitable information for improved performance of washing machine appliance 100.

External communication system 190 permits controller 166 of washing machine appliance 100 to communicate with external devices either directly or through a network 192. For example, a consumer may use a consumer device 194 to communicate directly with washing machine appliance 100. For example, consumer devices 194 may be in direct or indirect communication with washing machine appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with washing machine appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with washing machine appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Referring again to the embodiment of FIG. 1, door 134 may further include air intake openings 206. Air intake openings 206 may be one or more openings in door 134 that permit air to pass between the outside and the inside of wash tub 124. To enable this function, air intake openings 206 may be located on both the interior and exterior surfaces of door 134. In some embodiments, air intake openings 206 may constitute numerous small, individual openings. In alternative embodiments, air intake openings 206 may constitute only a single opening. The surface area of the air intake openings 206 (or the combined surface area in the case of multiple air intake openings 206) may be varied to control, in part, the flow of air between the exterior and interior of the tub. In some embodiments, it may be desirable to include a screen or other filter (not pictured) over the air intake openings to discourage the passage of lint or other solids from entering the wash tub 124. Although air intake openings 206 are located in door 134 in the embodiment of FIG. 1, it will be recognized that air intake openings 206 may be located elsewhere on washing machine appliance 100 in alternative embodiments. Indeed, air intake openings 206 may be located anywhere that would allow passage of air between the inside and the outside of wash tub 124, such as on a surface of cabinet 130.

As shown in FIG. 1, washing machine appliance 100 may further include a damper 208. In the embodiment of FIG. 1, damper 208 may include a first end 210 and a second end 212. A damper opening 214 may be located at the second end 212 of damper 208. Damper 208 may be movable between an open and closed position, wherein the open position is characterized by alignment of damper opening 214 with air intake openings 206 and the closed position is characterized by alignment of the first end 210 of damper 208 with air intake openings 206. When in the closed position, damper 208 blocks the passage of air between the inside and the outside of wash tub 124. Conversely, in the open position, damper 208 permits such air flow. Although a particular embodiment of damper 208 is provided in FIG. 1, it will be recognized that other embodiments for selectively permitting air flow into the wash tub 124 through air intake openings 206 fall within the scope of the present disclosure. For example, in some embodiments, damper 208 may lack a damper opening 214 altogether. In such an embodiment, the open position of damper 208 is characterized by no portion of damper 208 being position in alignment with air intake openings 206. In still other embodiments, damper opening 214 may consist of a plurality of openings corresponding to the plurality air intake openings 206. In such embodiment, opening or closing of damper 208 need not involve movement from a first end 210 to a second end 212 (or vice versa), but rather shifting of the alignment of the plurality of damper openings 214 with the plurality of air intake openings 206. In still other embodiments, damper 208 may consist of a series of planar elements aligned with the air intake openings 206 that individually rotate about a vertical axis, the rotation resulting in covering and uncovering the air intake openings 206. Those of ordinary skill will recognize that other embodiments of a moving damper that selectively allow air flow through the air intake openings 206 are intended to fall within the scope of the present disclosure.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., a combination washer/dryer appliance. Indeed, it should be appreciated that aspects of the present subject matter may further apply to other laundry appliances, such a dryer appliance. In this regard, the same methods and systems as described herein may be used to initiate and terminate drying cycles under certain circumstances in other appliances, such as a dryer appliance.

Figure 3:
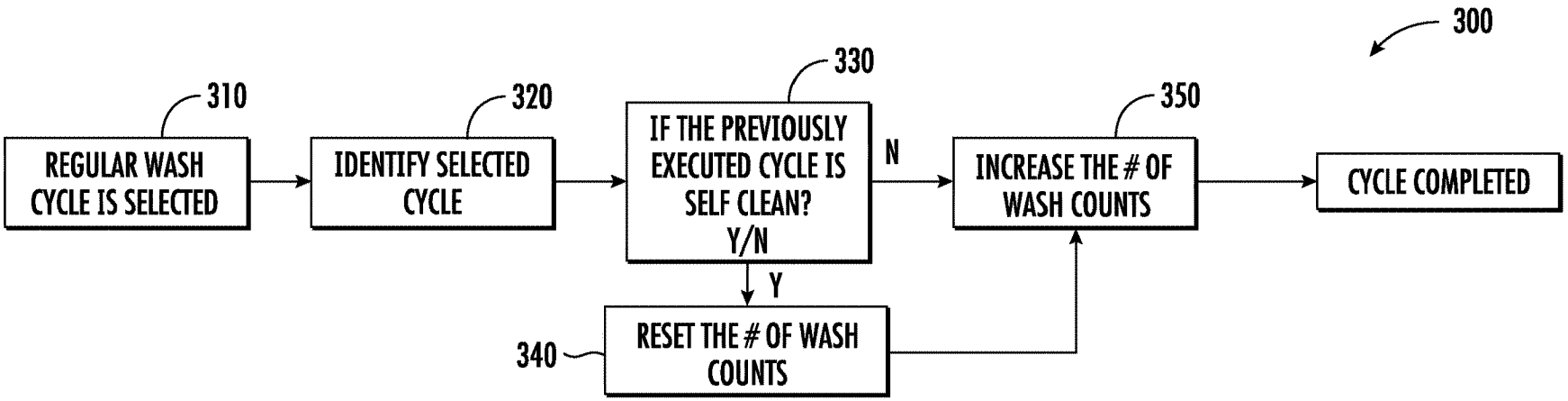
FIG. 3 provides a flow diagram illustrating a portion of an exemplary process for tracking a number of wash cycles since the previous self-clean cycle according to an exemplary embodiment of the present subject matter.

Now that the construction of washing machine appliance 100 and the configuration of controller 166 according to exemplary embodiments have been presented, an exemplary method 300 of operating a washing machine appliance will be described. Referring now to FIGS. 3, a user selects a laundry cycle at the user interface (e.g., control panel 160, input selectors 162) at step 310. Users may select from a variety of laundry cycles. These laundry cycles may generally be divided into wash cycles and maintenance cycles. Wash cycles generally involve the insertion of articles of laundry into wash chamber 126 prior to execution of a cycle and serve to treat those articles of laundry (e.g., introducing detergents, stain removers, softeners, and other additives) during the course of the wash cycle.

Maintenance cycles, in contrast, are intended to address the cleanliness of the washing machine itself. Accordingly, these maintenance cycles are generally run when wash chamber 126 is empty of any articles of laundry. Indeed, the presence of articles of laundry during a maintenance cycle would be undesirable, as the articles would interfere with the cleaning of the appliance and could, in some cases, be damaged as a result of high water temperatures, high rotation speeds, and other washing conditions associated with the maintenance cycle. Exemplary types of maintenance cycles include self-cleaning cycles and drying cycles. A self-cleaning cycle is intended to clean portions of tub 124 where moisture and detergent or other residue may gather. A self-clean cycle may involve one or more periods of soaking the tub to encourage the loosening of dirt followed by high speed rotation to encourage detachment of any dirt or mold. Self-cleaning cycles can be rather lengthy (e.g., between 4-8 hours or more). A drying cycle, as its name implies, is intended to dry the interior of chamber, most importantly cracks and crevices where mold tends to form. In the absence of adequate drying, over time, mold may form and emit odors that affect the perceived effectiveness of the washing machine's wash cycle.

In the embodiment of FIG. 3, step 310 involves the user selection of a cycle. Here, the user selects a wash cycle. At step 320, the controller 166 identifies the selected cycle based the user input at user interface. If, as in this embodiment, the selected cycle is a wash cycle, controller 166 determines whether the most recent cycle executed by the washing machine appliance 100 was a self-clean cycle at step 330. More specifically, various data associated with washing machine appliance 100 and its operations may be stored in memory, as noted above. In some embodiments, this, this data may include details of one or more previous executed cycles. In this embedment, the determination by controller 166 of the most recent executed cycle involves accessing memory and retrieving the previous executed cycle data.

The determination of the previous executed cycle at 330 may return a result indicating either that the previous execute cycle was a self-clean cycle or that it was not. Depending on the result, controller 166 may update a wash counter. The wash counter is a data element that may be stored in memory and that provides an indication of the number of wash cycles that have occurred in washing machine appliance 100 since the wash count was last reset. In the embodiment of FIG. 3, if it is determined that the previously executed cycle was a self-clean cycle, controller 166 resets the wash counter to 0 at step 340 and stores the updated wash counter in memory for later use. Alternatively, if it is determined that the previously executed cycle was not a self-clean cycle, controller 166 increments the current count of the wash counter by 1 at step 350 and stores the updated wash counter in memory for later use.

Figure 4:
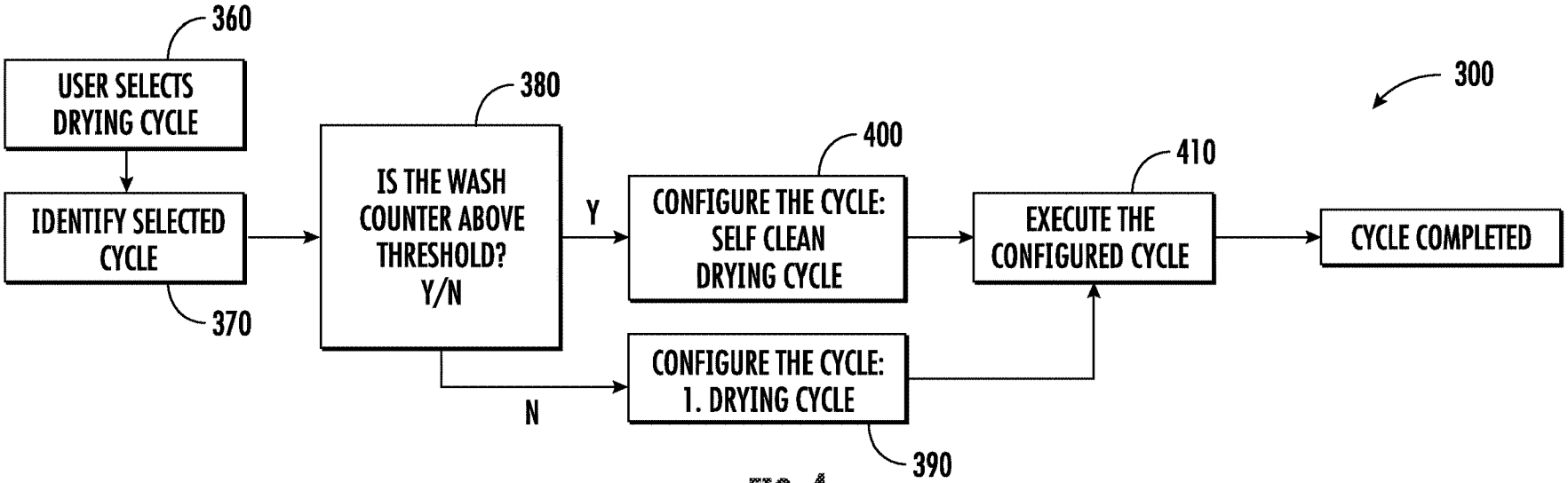
FIG. 4 provides a flow diagram illustrating a portion of an exemplary process for implementing an automated self-clean cycle in response to selection of a drying cycle according to an exemplary embodiment of the present subject matter.

Referring now to FIG. 4, in this embodiment, the user selects a maintenance cycle, and specifically a drying cycle, by providing an input at the user interface (e.g., control panel 160 or input selectors 162) at step 360. As before, controller 166 may identify the selected cycle based on the input from the user interface at step 370. Notably, because a maintenance cycle has been identified, chamber 126 may be empty (i.e., no articles of laundry are within chamber 126). If, as in this embodiment, a drying cycle is selected, controller 166 determines whether the current value of the wash counter exceeds a predetermined threshold. As noted above, the wash counter is incremented for every wash cycle that occurs without an intervening self-clean cycle. That data is retrieved from memory by controller 166 and compared to the predetermined threshold. The predetermined threshold is a fixed value stored in memory and indicative of the preferred maximum number of wash cycles to execute without an intervening self-clean cycle. That number may vary depending a variety of factors including, for example the frequency of wash cycles and the degree of dirt washed from the articles laundered in those cycles. For average use, the predetermined threshold may be 40 cycles, but this approximation is not intended to be limiting. Indeed, the value of the predetermined threshold may vary widely. One of ordinary skill in the art will recognize that the threshold value is dependent primarily on the contents being washed and the tolerance of the user for interruption by a lengthy self-clean cycle.

Upon determining whether the wash counter exceeds the predetermined threshold at step 380, method 300 next requires configuring an execution cycle based on the selected cycle and the determination whether that determination. The execution cycle represents the conditions of the actual cycle to be run by washing machine appliance 100. That is, although the user selected a particular cycle type, washing machine appliance 100 may require additional or alternative cycles based on data stored in memory. If it is determined that the wash counter does not exceed the predetermined threshold, the execution cycle continues with the selected cycle, in this case a drying cycle at step 390. Alternatively, if it is determined that the wash counter exceeds the predetermined threshold, then a self-clean cycle is necessary. It is desirable to initiate an automated self-clean cycle in combination with a drying cycle. This is because a user's execution of a drying cycle is an indication that a maintenance cycle is being performed and that there are not clothes or other articles of laundry within chamber 126. This condition is conducive to a self-clean cycle. Furthermore, selection of a drying cycle also indicates that the user is likely done with washing activities for some period of time, as there would be no reason to initiate a drying cycle if moisture is immediately reintroduced through a washing cycle. Accordingly, selection of a drying cycle by the user is understood to be a convenient time to also run a self-clean cycle.

Thus, at step 400, controller 166 may configure the execution cycle to include a combination cycle (i.e., two cycles run consecutively) consisting of a self-clean cycle followed by a drying cycle. Execution of the configured execution cycle is then initiated at step 410. Notably, where an execution cycle involves a combination cycle, such consecutive cycles occur automatically (i.e., without additional user input). Thus, in the exemplary embodiment of FIG. 4, for a configured cycle including a self-clean cycle followed by a drying cycle (e.g., step 400), the drying cycle is automatically executed at the conclusion of the self-clean cycle.

Figure 5:
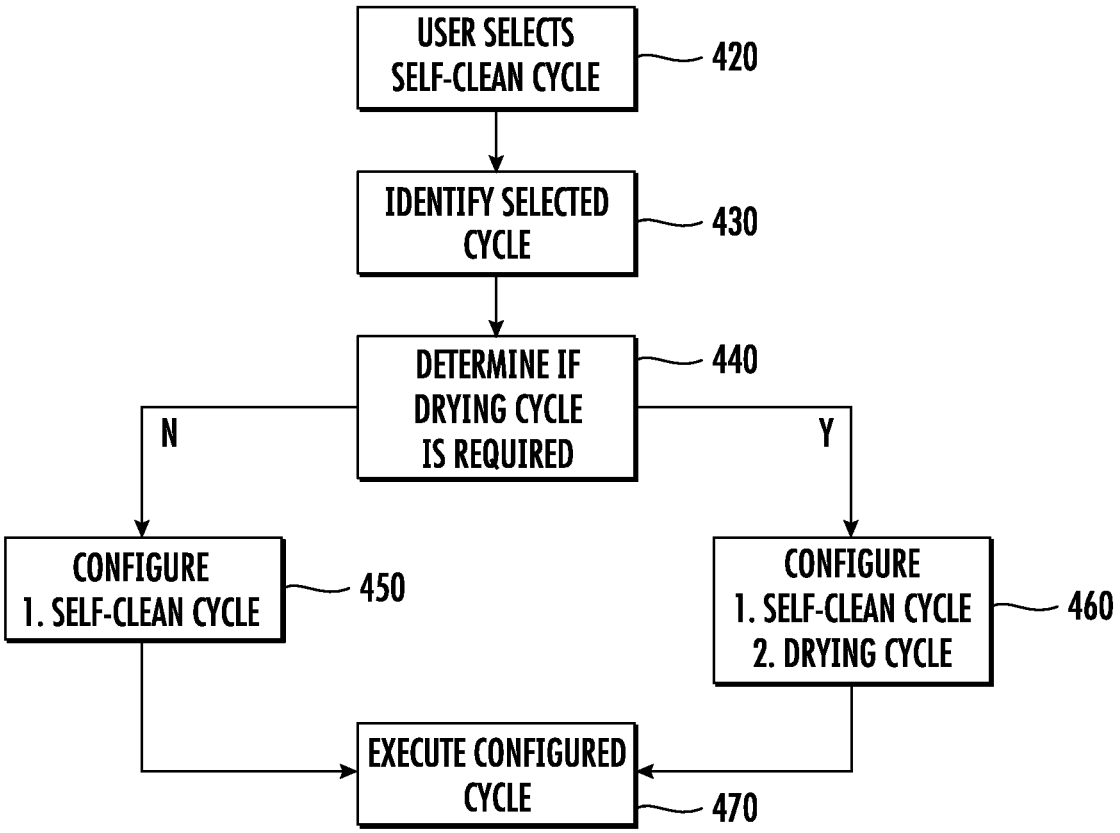
FIG. 5 provides a flow diagram illustrating a portion of an exemplary process for implementing an automated drying cycle in response to selection of a self-clean cycle according to an exemplary embodiment of the present subject matter.

In alternative embodiments, such as shown in FIG. 5, the user may select a self-clean cycle and such selection cycle may be identified by the controller 166 at steps 420 and 430. At step 440, controller 166 may determine whether a drying cycle is required. A drying cycle may be required for a variety of reasons. For example, a drying counter may have exceeded a predetermined threshold. The drying counter, like the wash counter, may be a data element stored in memory that is incremented by one after each cycle except for the running of a drying cycle, which resets the drying counter. The predetermined threshold may be as low as a 1 or as high as preference dictates. On average, the predetermined threshold may be every ten loads, or approximately once per week for the average family. Alternatively, the requirement of a drying cycle may be time-based (e.g., once per week and/or a certain time of day).

If it is determined that a drying cycle is not required, controller 166 configures the execution cycle to include a self-clean cycle at step 450. Alternatively, if it is determined that a drying cycle is required, controller 166 configures a combination cycle including a self-clean cycle followed by a drying cycle at step 460. The execution cycle is thereafter initiated at step 470. Notably, where an execution cycle involves a combination cycle, such consecutive cycles occur automatically (i.e., without additional user input). Thus, in the exemplary embodiment of FIG. 4, for a configured cycle including a self-clean cycle followed by a drying cycle (e.g., step 460), the drying cycle is automatically executed at the conclusion of the self-clean cycle.

FIGS. 3-5 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using washing machine appliance 100 as an example, it should be appreciated that these methods may be applied to the operation of any suitable washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine having a cabinet, a drum rotatably mounted within the cabinet and defining a chamber, a user interface for controlling operation of the laundry appliance, and a controller operably coupled to the user interface, the method comprising:

identifying a selected cycle from one or more selectable cycles based on an input from the user interface;

determining whether a wash counter exceeds a predetermined threshold if the selected cycle is a maintenance cycle comprising a drying cycle for drying an interior of the chamber;

configuring an execution cycle based on the selected cycle and the determination whether the wash counter exceeds the predetermined threshold if the selected cycle is a drying cycle, wherein the execution cycle includes the maintenance cycle and one or more of the selectable cycles other than the selected cycle; and executing the execution cycle.

2. The method of claim 1, wherein configuring the execution cycle further includes configuring a combination cycle that includes a self-clean cycle and a drying cycle if the wash counter exceeds the predetermined threshold.

3. The method of claim 2, wherein the drying cycle is automatically executed at the conclusion of the self-clean cycle.

4. The method of claim 1, wherein configuring the execution cycle further includes executing a drying cycle if the wash counter does not exceed the predetermined threshold.

5. The method of claim 1, the method further comprising determining if the most recent executed cycle was a self-clean cycle if the selected cycle is a wash cycle.

6. The method of claim 5, the method further comprising resetting the wash counter if the most recent executed cycle included a self-clean cycle.

7. The method of claim 5, the method further comprising incrementing the wash counter if the most recent executed cycle did not include a self-clean cycle.

8. The method of claim 1, the method further comprising configuring an execution cycle if the selected cycle is a self-clean cycle, wherein the execution cycle is a combination cycle that includes a self-clean cycle and a drying cycle.

9. The method of claim 8, the method further comprising automatically executing the drying cycle at the conclusion of the self-clean cycle.

10. The method of claim 1, the method further comprising configuring an execution cycle based on the selected cycle and the determination whether a dryer counter exceeds the predetermined threshold if the selected cycle is a self-clean cycle, wherein the execution cycle includes a self-clean cycle followed by a drying cycle if the dryer counter exceeds a predetermined threshold and wherein the execution cycle includes only a self-clean cycle if the dryer counter does not exceed a predetermined threshold.

11. The method of claim 10, wherein the dryer counter is incremented each time the washing machine executes a cycle that does not include a drying cycle.

12. The method of claim 11, wherein the dryer counter is reset upon execution of a drying cycle.

13. A method of operating a washing machine having a cabinet, a drum rotatably mounted within the cabinet and defining a chamber, a user interface for controlling operation of the laundry appliance, and a controller operably coupled to the user interface, the method comprising:

identifying a maintenance cycle comprising a drying cycle for drying an interior of the chamber based on an input from the user interface;

determining whether a wash counter exceeds a predetermined threshold;

configuring an execution cycle based on the identification of the maintenance cycle and the determination whether the wash counter exceeds the predetermined threshold that includes the drying cycle; and executing the execution cycle.

14. The method of claim 13, wherein configuring the execution cycle further includes configuring a combination cycle that includes a self-clean cycle and a drying cycle if the wash counter exceeds the predetermined threshold.

15. The method of claim 14, wherein the drying cycle is automatically executed at the conclusion of the self-clean cycle.

16. The method of claim 15, wherein configuring the execution cycle further includes executing only a drying cycle if the wash counter does not exceed the predetermined threshold.

17. The method of claim 15, the method further comprising automatically executing the drying cycle at the conclusion of the self-clean cycle.

18. The method of claim 13, wherein the wash counter is incremented after each wash cycle and reset after each self-clean cycle.

* * * * *